US008079372B2

(12) United States Patent
Smith, IV et al.

(10) Patent No.: US 8,079,372 B2
(45) Date of Patent: Dec. 20, 2011

(54) DISCREET PACKING SYSTEM

(76) Inventors: Bartlett Wade Smith, IV, Madison, MS (US); James Albert Norris, III, Madison, MS (US)

( * ) Notice: Subject to any disclaimer, the term of this patent is extended or adjusted under 35 U.S.C. 154(b) by 463 days.

(21) Appl. No.: 12/386,991

(22) Filed: Apr. 28, 2009

(65) Prior Publication Data

US 2009/0266370 A1 Oct. 29, 2009

Related U.S. Application Data

(60) Provisional application No. 61/071,428, filed on Apr. 29, 2008.

(51) Int. Cl.
*A24F 23/00* (2006.01)

(52) U.S. Cl. ..... 131/329; 131/111; 131/112; 206/256; 206/258; 220/530

(58) Field of Classification Search ..... 131/329, 131/70, 283; 206/242, 256, 264, 265, 258; 220/530, 547, 550
See application file for complete search history.

(56) References Cited

U.S. PATENT DOCUMENTS

| | | | | | |
|---|---|---|---|---|---|
| 1,336,228 | A * | 4/1920 | Heasley | 232/4 R |
| 1,381,831 | A * | 6/1921 | Heeren | 229/123.2 |
| 1,451,622 | A * | 4/1923 | Marston | 220/8 |
| 2,092,219 | A * | 9/1937 | Knox | 206/236 |
| 2,157,255 | A * | 5/1939 | Bumpass | 229/5.5 |
| 2,565,808 | A * | 8/1951 | Friedman | 206/253 |
| 4,612,943 | A * | 9/1986 | Meinkowsky | 131/329 |
| 4,804,101 | A * | 2/1989 | Heath | 220/504 |
| 5,752,599 | A * | 5/1998 | Veltman | 206/236 |
| 7,798,319 | B1 * | 9/2010 | Bried et al. | 206/242 |
| 2005/0173272 | A1 * | 8/2005 | Lemmons, IV | 206/256 |
| 2008/0202956 | A1 * | 8/2008 | Welk et al. | 206/265 |
| 2010/0012534 | A1 * | 1/2010 | Hoffman | 206/265 |

FOREIGN PATENT DOCUMENTS

| | | | |
|---|---|---|---|
| JP | 09295674 | A * | 11/1997 |
| WO | WO 2008066450 | A1 * | 6/2008 |

OTHER PUBLICATIONS

JP 09-295674 (Machine Translation) [online], [retrieved on Sep. 22, 2011], retrieved from PAJ Database (http://www19.ipdl.inpit.go.jp/PA1/cgi-bin/PA1INDEX).*

* cited by examiner

*Primary Examiner* — Matthew Daniels
*Assistant Examiner* — Yana Belyaev
(74) *Attorney, Agent, or Firm* — Todd B. Murrah

(57) ABSTRACT

A discreet packing system for containing and compacting finely chopped tobacco product having a shallow cylindrical body and a lid detachably secured thereto. A flexible wall is secured at a fixed end to the interior surface of the body. The flexible inner wall generally coextends the interior surface of the body and thereby defines a cylindrical volume in which the tobacco is contained. The flexible wall may be selectively locked in place relative to the outer wall of the body. In one embodiment of the present invention, a bottom is slidably connected to a cylindrical outer wall of the body. A distal end of the flexible wall is attached to the bottom and is urged via rotation of the bottom relative to the outer wall. Other embodiments are provided wherein the flexible wall extends through the body and is urged via a grip or slider.

20 Claims, 9 Drawing Sheets

DISCREET PACKING SYSTEM

REFERENCE TO PROVISIONAL APPLICATION

Applicant hereby references, relies on and incorporates herein by reference, U.S. Provisional Application No. 61/071,428 filed Apr. 29, 2008 by the Inventors identified in the present invention, Bartlett Wade Smith IV and James Albert Norris III, both of Madison, Miss. Applicants claim a filing date for this Application of Apr. 29, 2008.

FIELD OF THE INVENTION

The present invention relates to containers and more particularly to containers having a selectively collapsible interior. In greater particularity the present invention relates to containers for the storage of finely chopped tobacco with a focus of compacting the tobacco to maintain its freshness and for easier and more discreet extraction from the container.

BACKGROUND OF THE INVENTION

The use of tobacco by placing a small quantity of finely chopped tobacco product between the user's lower lip or cheek and gum dates back far past the existence of recorded patents. Accordingly, for a prolonged history, there have been containers for carrying the finely chopped tobacco product. Generally speaking, those containers have included flexible pouches and rigid "tins" or boxes. Though there have been advances in technology for these containers, such advances have been relatively limited.

In the instance of pouches, paper pouches lined with aluminum, plastic, and other hermetically impermeable substances have been used to carry the tobacco. These pouches allow the user to manually compress the tobacco within the hermetically sealed pouch minimizing the exposure of the finely chopped tobacco to air. The misfortune of these hermetically sealed pouches is that they are bulky, subject to tear, and when used to access the tobacco, retain a residue of tobacco on the upper surfaces of the pouch that unnecessarily soils the hand of the user.

Also, many tobacco users seek a level of discretion when using a tobacco product. To some, tobacco use in public may be perceived as offensive or rude and anything that calls attention to the act is not desired. The use of a hermetically sealed pouch usually involves unrolling the pouch which historically was designed to be large enough to insert the entire hand, use the tobacco, roll up the pouch and put the pouch away. Typically the pouch was so large that it was difficult to place the pouch into a user's pants pocket because of its size.

The most recent and technologically advanced container for chopped tobacco is a small shallow cylindrical container having a detachable lid. Such containers are typically made of plastic to help isolate the tobacco from the atmosphere. Of course, even with these containers, the interior of the container is exposed to the atmosphere when the lid is opened. Also, as the containers are designed to fit within the back pockets of a user's pants, the container is typically sized to a diameter which will fit comfortably within the grip of a user's hand. However, once the lid is opened, it is not uncommon that the finely chopped tobacco will not spill due to the loose arrangement of the tobacco within the plastic container. After any use of the product, the finely ground tobacco becomes more loosely arranged within the container and thus has more surface area of the tobacco particulate that is exposed to the atmosphere.

In sum, the current containers do not keep the finely ground tobacco compacted. It is this compaction that is necessary to minimize the exposure of the finely ground tobacco surfaces to the atmosphere. Also compaction makes it much easier for the user to pinch a portion of the tobacco between his or her thumb and forefinger to remove the tobacco from the can. Currently, it is common for users to hold the container with the lid on and "pop" the container with a short brisk repetitive motion of the arm. The movement compacts the tobacco momentarily within the can using inertia. The compaction is not necessarily complete and the action of compacting the tobacco in this manner again attracts attention to other people near the tobacco user.

These inventors have conducted a search to determine what, if any, prior art exists relative to containers for storing and/or compacting finely chopped or granulated product. The patents produced by this search are listed as follows:

| PATENT NO. | INVENTOR |
|---|---|
| U.S. Pat. No. 6,923,347 B2 to | Winckels |
| U.S. Pat. No. 6,918,511 B1 to | Spatz, et al |
| U.S. Pat. No. 3,901,414 to | Capra, et al |
| JP Patent No. 9295674 | |
| JP Patent No. 2006056592 | |

SUMMARY OF THE INVENTION

As herein described, the present invention provides a discreet packing system for containing and compacting finely chopped tobacco product. The packing system is a shallow cylindrical body having a cylindrical outer wall, a bottom or base and a detachable lid. Within the cylindrical body is a flexible inner wall which is connected, at a fixed end, to an interior surface of the cylindrical outer wall. The flexible inner wall extends generally around the inner cylindrical surface when the inner wall is in a non-compacting alignment or position. The flexible inner wall, in combination with the bottom and lid, thus forms a cylindrical volume wherein tobacco can be stored.

The packing system is further defined by several embodiments including various apparati for urging a distal end of the flexible inner wall in relation to the fixed end of the flexible inner wall such that the flexible inner wall winds about itself to compress the tobacco stored in the cylindrical volume formed by the flexible inner wall, bottom and lid. These embodiments include a rotable bottom slidably connected to the cylindrical outer wall at a lower edge thereof. The bottom is aligned with the cylindrical wall for coaxial rotation relative thereto. The distal end of the flexible wall is connected to the rotable bottom such that rotation of the bottom in one direction will collapse the flexible wall to compact the tobacco contained by the flexible wall.

Another embodiment for urging the flexible wall incorporates the use of an aperture in the cylindrical outer wall of the body through which the flexible wall extends such that a grip or slider mounted at the distal end of the flexible wall can be manually manipulated by the user to pull the flexible wall through the outer wall of the cylindrical body.

Yet another embodiment of the present invention includes a guide pocket formed within the containing body in which the distal end of the flexible wall is received. A slot in the guide pocket provides access to the flexible wall such that the slider, which is mounted to the flexible wall, can be urged to manipulate the flexible inner wall.

In these embodiments, opposed pluralities of teeth may be formed on the rotating bottom and lower edge of the outer cylindrical wall or alternatively on the flexible wall and either that portion of the outer wall forming the aperture or the guide pocket such that the opposing teeth can selectively lock the flexible wall in place to maintain compression on the tobacco product stored within the container.

The primary object of the present invention is to provide a container for storing tobacco that provides the user easy and discreet access to the tobacco product. Another advantage of the invention is to provide a container for storing tobacco that provides a constant compression of the stored tobacco to minimize exposure of the tobacco to air and thus maintain the freshness of the stored tobacco. Another benefit of the present invention is that, by maintaining the tobacco in a compacted condition within the container, the user may more easily access, pinch and use the tobacco with less risk of spillage and without drawing undue attention. Lastly, the present invention incorporates a container shape and size commonly recognized in the industry of dipping tobacco and their customers.

BRIEF DESCRIPTION OF THE DRAWINGS

Apparatus embodying features of our invention are depicted in the accompanying drawings which form a portion of this disclosure and wherein.

DESCRIPTION OF A PREFERRED AND ALTERNATE EMBODIMENTS OF THE PRESENT INVENTION

Figure 1:
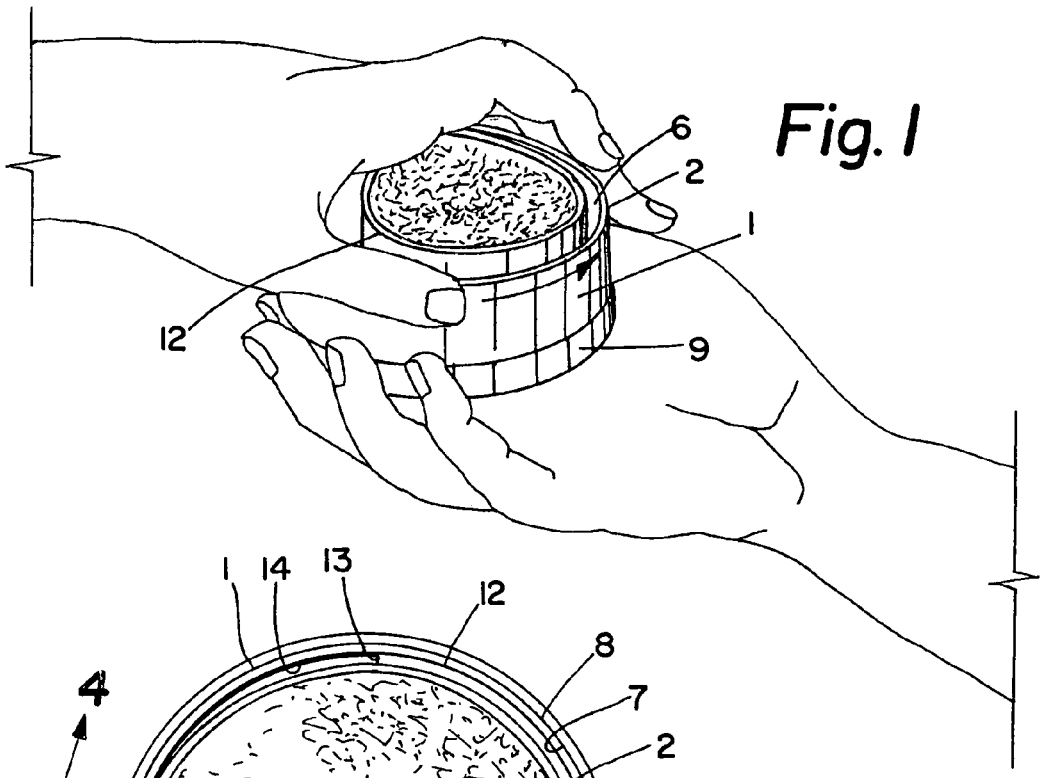
FIG. 1 is a perspective view of a preferred embodiment of the present invention with the lid removed and the inner wall urged to compact the tobacco.
Figure 2:
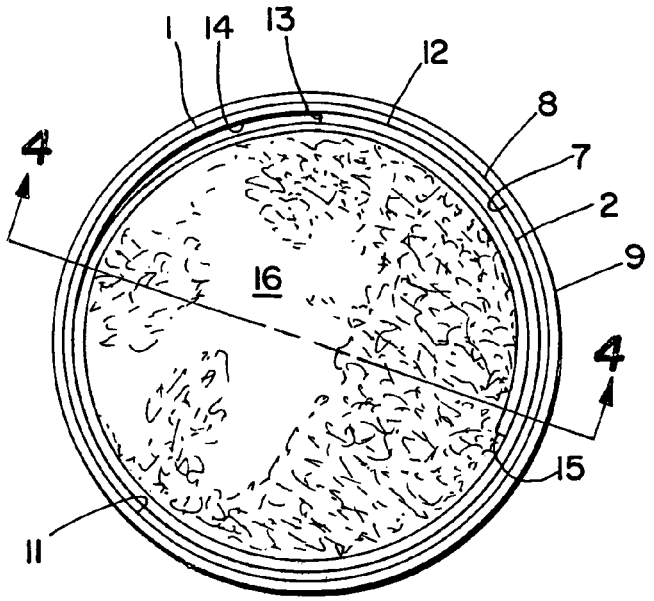
FIG. 2 is a top plan view of a preferred embodiment of the present invention with the lid removed and the inner wall in a non-compacting position.
Figure 3:
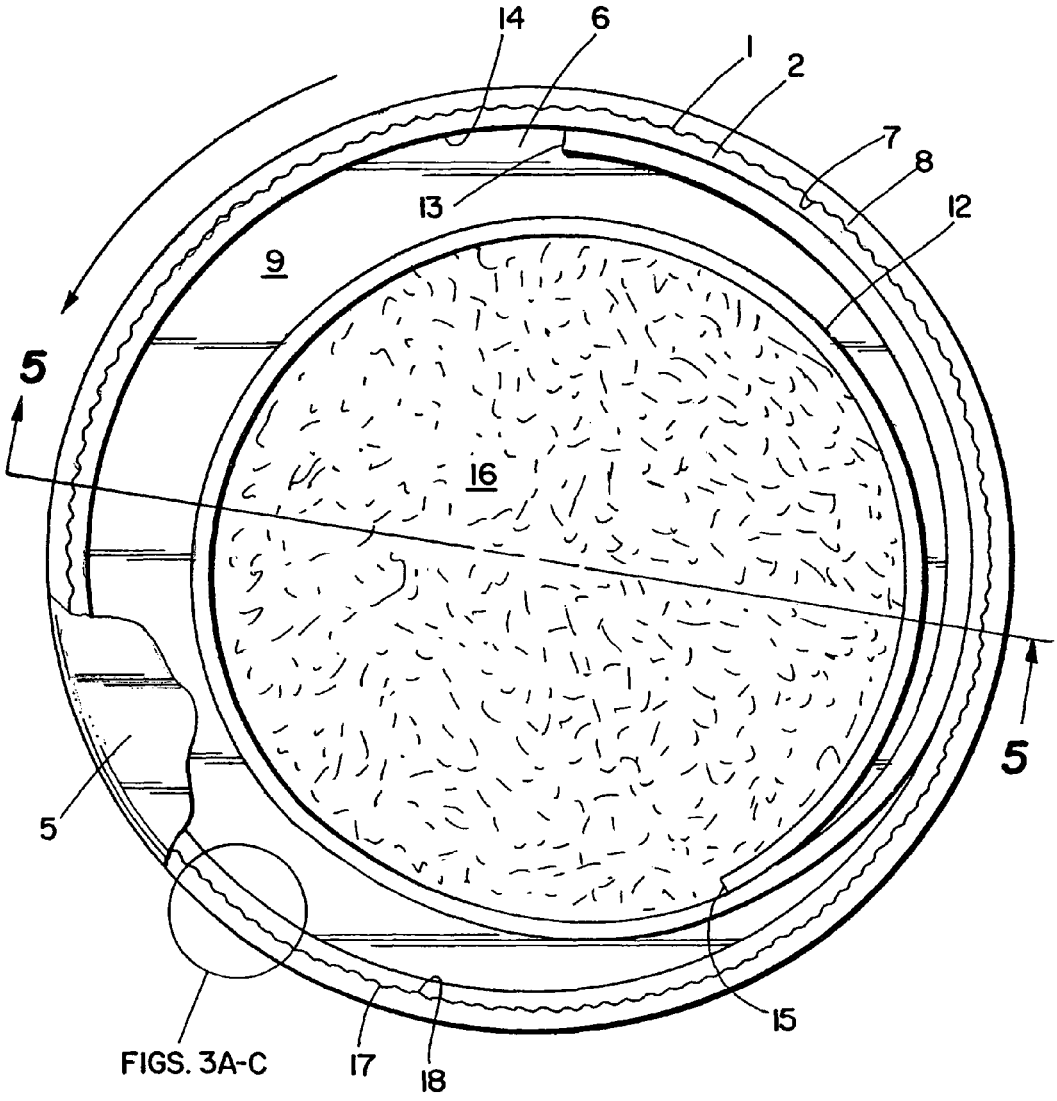
FIG. 3 is a top plan view of a second embodiment of the present invention with the lid removed and the inner wall urged to compact the tobacco.
Figure 4:
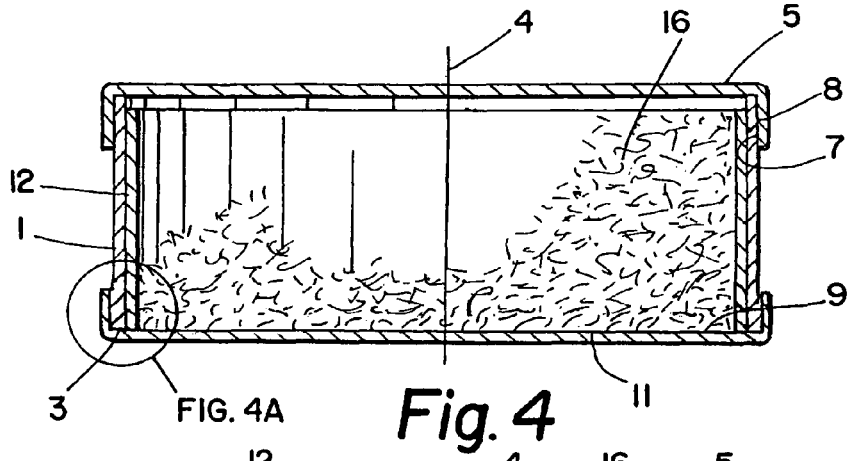
FIG. 4 is a sectional view taken along line 5-5 of FIG. 3 with the inner wall in a non-compacting position.
Figure 5:
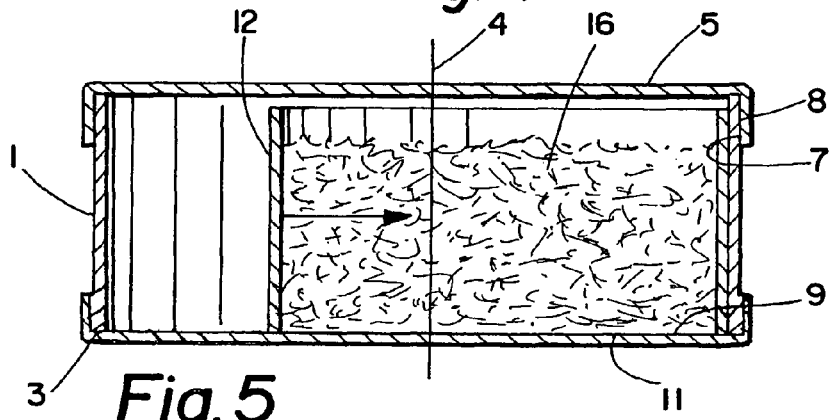
FIG. 5 is a sectional view taken along line 5-5 of FIG. 3 with the inner wall urged to a compacting position.

Referring to FIGS. 1 through 17 of the drawings for a clearer understanding of the invention, it should be noted that the preferred embodiment of the invention, shown in FIGS. 1 and 2, includes a substantially cylindrical outer wall 1 defining a circular upper edge 2 and a circular lower edge 3, each circumscribing a common axis 4. A second embodiment of the present invention is shown in FIGS. 3-5. Both the first embodiment and the second embodiment include a lid 5 detachably connected to the upper edge 2 of the cylindrical outer wall 1 and covering an upper opening 6 defined by the upper edge 2. Means for detachably securing the lid 5 to the cylindrical body 1 may include any of those common components currently known in the industry including the simple frictional adhesion of the an inner surface 7 defined by the lid 5 and an outer surface 8 defined by the outer wall 1.

Figure 6:
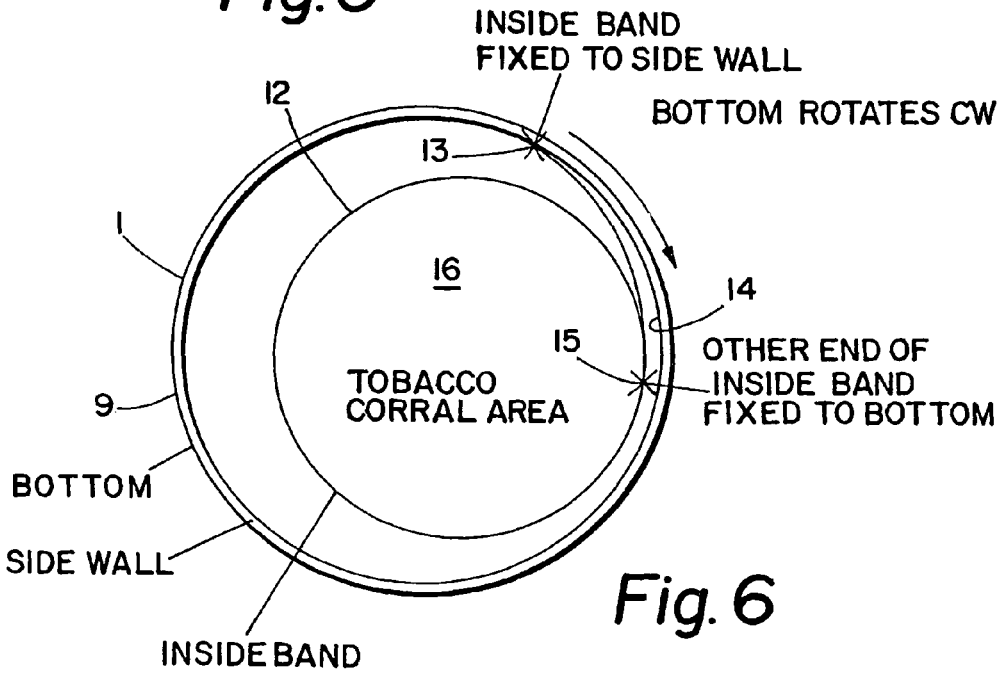
FIG. 6 is a generalized top plan view used to show the relationship between the flexible inner wall and the attachment of the fixed and distal end thereof to the outer wall and bottom, respectively.

The preferred and second embodiments additionally include a bottom 9 slidably connected to the outer wall 1 for rotation about the common axis 4 and covering a lower opening 11 defined by the lower edge 3 of the outer wall 1. A flexible inner wall 12 is attached at a fixed end 13 to an interior surface 14 of the outer wall 1 and extends generally along this interior surface 14 of the outer wall 1 to a distal end 15 which is connected to the bottom 9. As shown in FIG. 6, from a top down perspective, the bottom 9 can be rotated in a first direction (clockwise, according to FIG. 6), to urge the distal end 15 along the flexible inner wall 12 and generally adjacent to the circumference of the inner surface 14 of the outer wall 1 to cause the flexible inner wall 12 to wind upon itself and collapse a cylindrical volume 16 defined by the flexible inner wall 12, the lid 5 and the bottom 9.

As shown in FIGS. 1, 3 and 6, the rotational movement of the bottom 9 is relative to the outer wall 1 and thus it is foreseeable that the outer wall 1 could be rotated counter-clockwise while holding the bottom 9 stationary to provide the same effect. It should also be obvious to one skilled in the art that the flexible inner wall 12 could be inverted and the bottom 9 and/or cylindrical outer wall 1 be rotated in opposite directions to facilitate the collapse of the cylindrical volume 16.

As shown in FIG. 2, the bottom 9 may be rotated in an opposite second direction (counter-clockwise in FIG. 2) to return the flexible inner wall 12 to a non-compacting position. The non-compacting position urges the flexible wall 12 in contact with the interior surface 14, maximizing the cylindrical volume 16. Obviously, tobacco is initially placed in the invention with the flexible inner wall 12 urged to the non-compacting position.

Figure 3A:
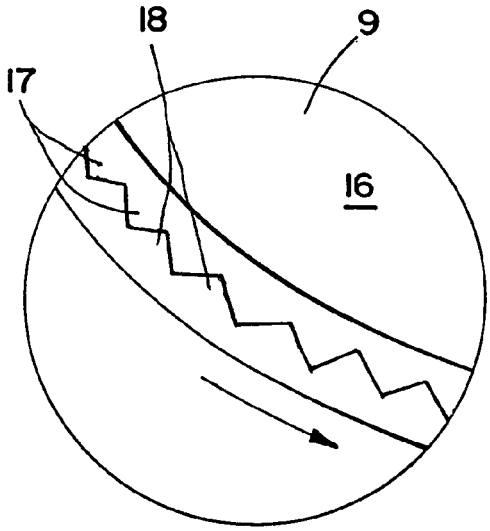
FIG. 3A is a detailed view of the second embodiment of the present invention taken from FIG. 3, showing the opposing bottom teeth and outer wall teeth.

FIGS. 3 and 3A show a second embodiment of the present invention wherein the bottom 9 defines a plurality of bottom teeth 17 set in opposing interlaced relation to a plurality of similarly opposed outer wall teeth 18 defined by the outer wall 1. These teeth 17 and 18 are sloped and constructed of a material having a relatively high degree of plasticity that will allow the bottom 9 to be selectively rotated in either direction relative to the outer wall 1 while correspondingly locking the bottom 9 in temporarily fixed relation to the outer wall 1 when rotation is complete. Thus, the user may rotate the bottom 9 to compact the contained tobacco then release the bottom 9. The teeth 17 and 18 will thus prevent the expansive nature of the compressed tobacco from urging the flexible inner wall 12 toward the non-compacted position. However, should the user elect to voluntarily rotate the bottom 9 to urge the flexible inner wall 12 toward the non-compacted position, the slope and plasticity of the teeth would accommodate this movement.

Figure 3B:
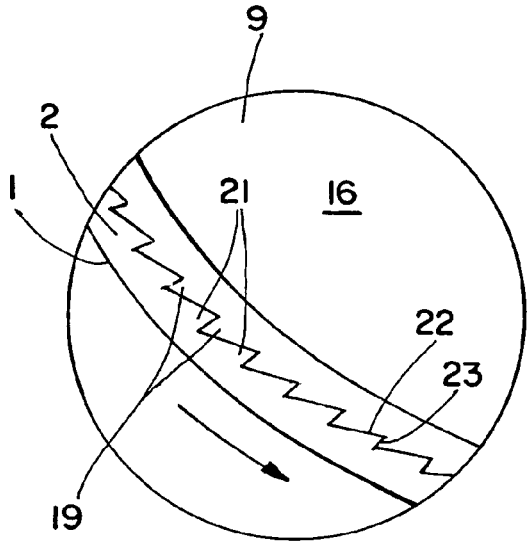
FIG. 3B is a detailed view of the second embodiment of the present invention taken from FIG. 3, showing the alternate bottom teeth and alternate outer wall teeth.

Alternatively, another embodiment of the invention shown in FIG. 3B would utilize a plurality of first alternate bottom teeth 19 and a plurality of first alternate outer wall teeth 21. Each of teeth 19 and 21 have one sloped side 22 and one radial side 23 which is generally disposed in radial relation to the common axis 4 such that movement of the bottom 9 in a second direction (counter-clockwise in FIG. 3) to urge the flexible inner wall 12 toward a non-compacting position would be resisted by the teeth 19 and 21. Teeth 19 and 21 would thus prevent inadvertent decompaction of the contained tobacco.

Figure 3C:
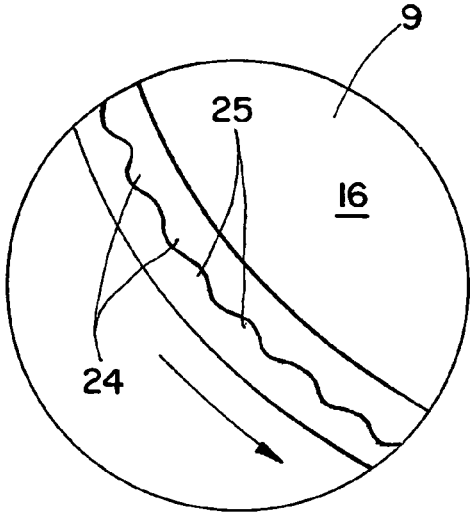
FIG. 3C is a detailed view of the second embodiment of the present invention taken from FIG. 3, showing the second alternate bottom teeth and second alternate outer wall teeth.

In yet another embodiment of the present invention, shown in FIG. 3C, a plurality of second alternate bottom teeth 24 are defined by the bottom 9 and a plurality of second alternate outer wall teeth 25 are defined by the outer wall 1. The teeth 24 and 25 are rounded as shown in FIG. 3C to facilitate easier rotation of the bottom 9 relative to the outer wall 1.

Figure 4A:
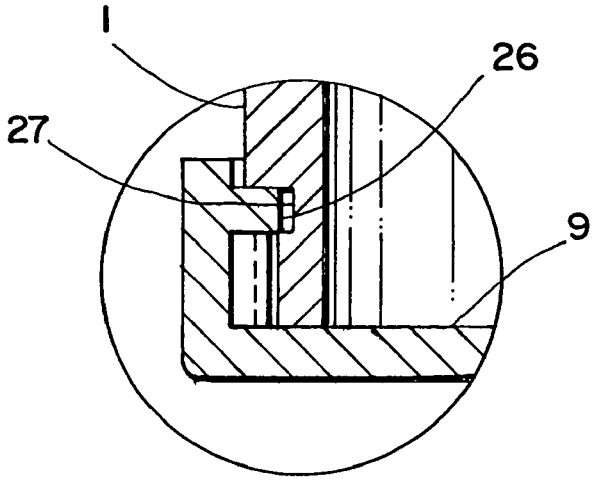
FIG. 4A is a detailed view taken from FIG. 4.
Figure 7:
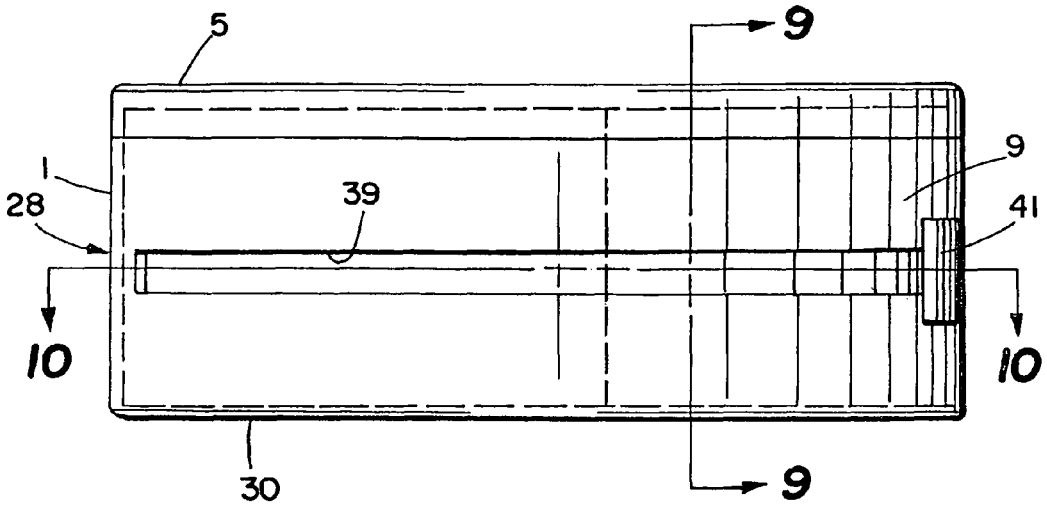
FIG. 7 is a side view of a third embodiment of the present invention.

In the preferred and second embodiment and any derivative embodiments having a slidably rotating bottom 9, the bottom 9 is attached to the outer wall 1, as shown in FIG. 4A, using a concentric ridge 26, defined by the bottom 9, and a corresponding groove 27, defined by the outer wall 1, in which the ridge 26 is seated for sliding movement. Numerous other methods for slidably attaching the bottom 9 to the outer wall 1 are known in the art.

Figure 11:
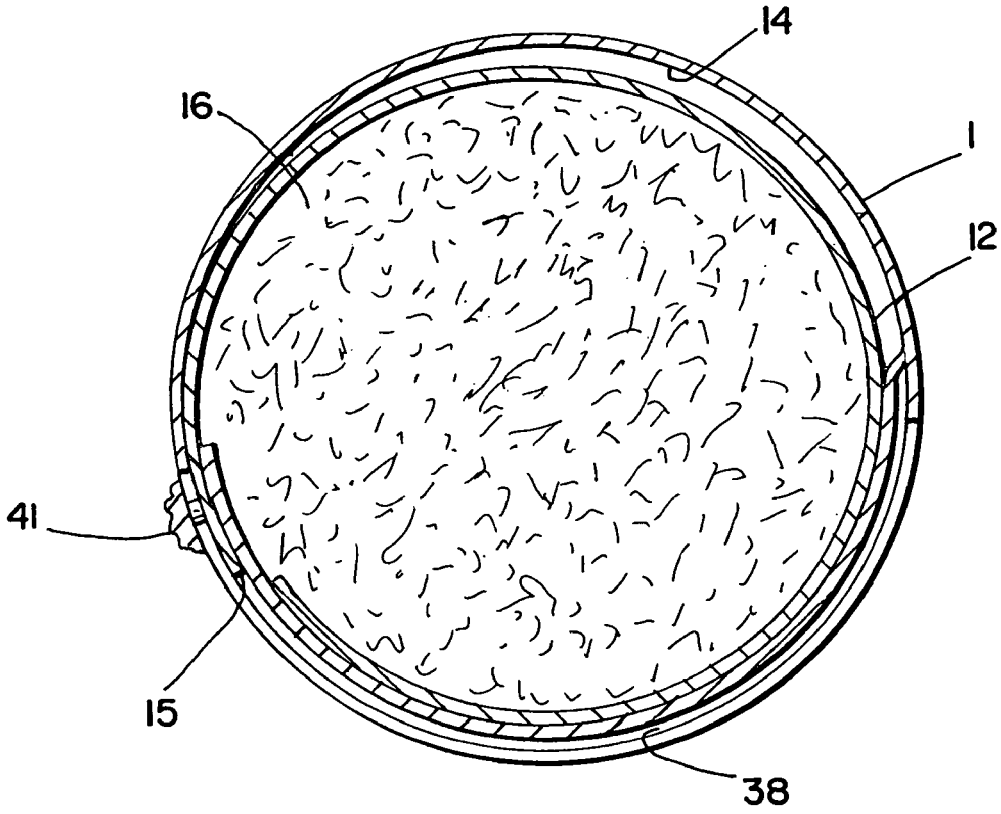
FIG. 11 is a sectional view taken along line 10-10 of FIG. 7 showing the inner wall in a non-compacting position.
Figure 10:
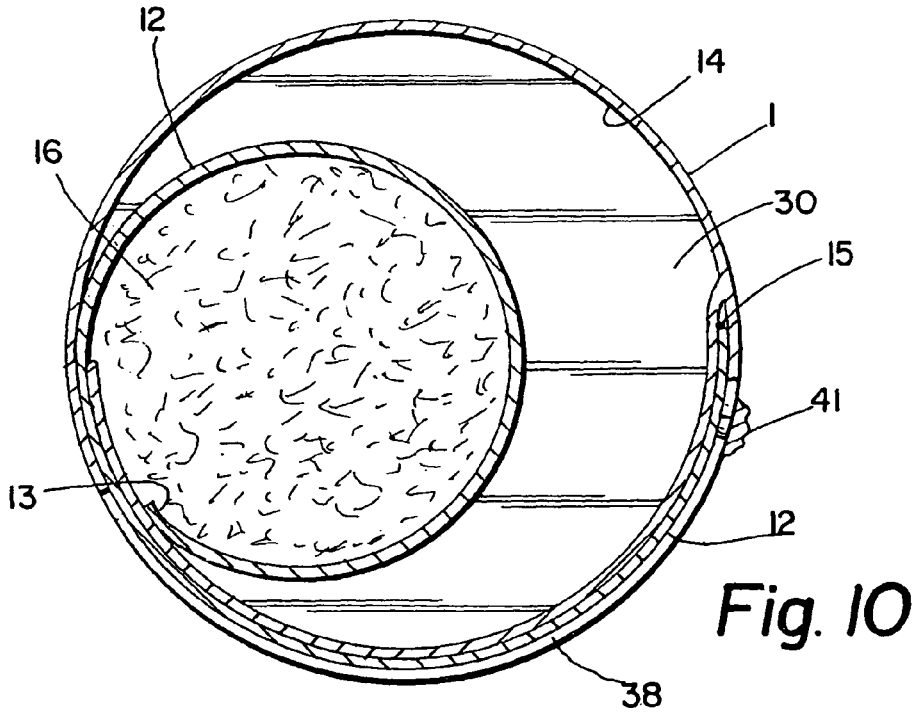
FIG. 10 is a sectional view taken along line 10-10 of FIG. 7 showing the inner wall urged to a compacting position.
Figure 12:
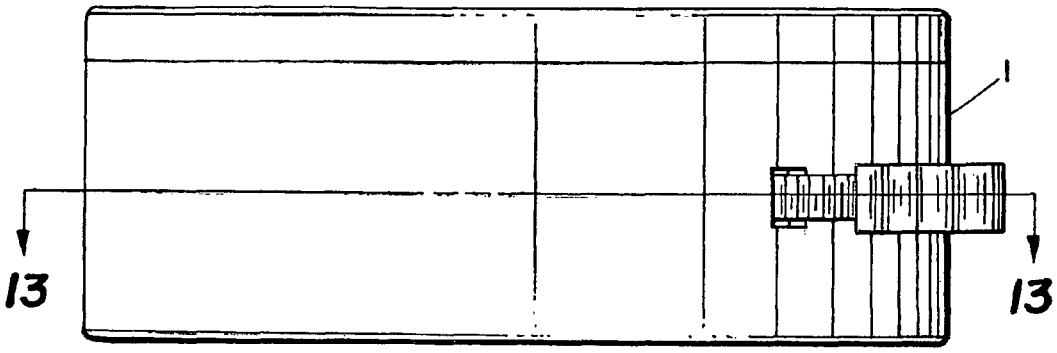
FIG. 12 is a side view of a fifth embodiment of the present invention.
Figure 13:
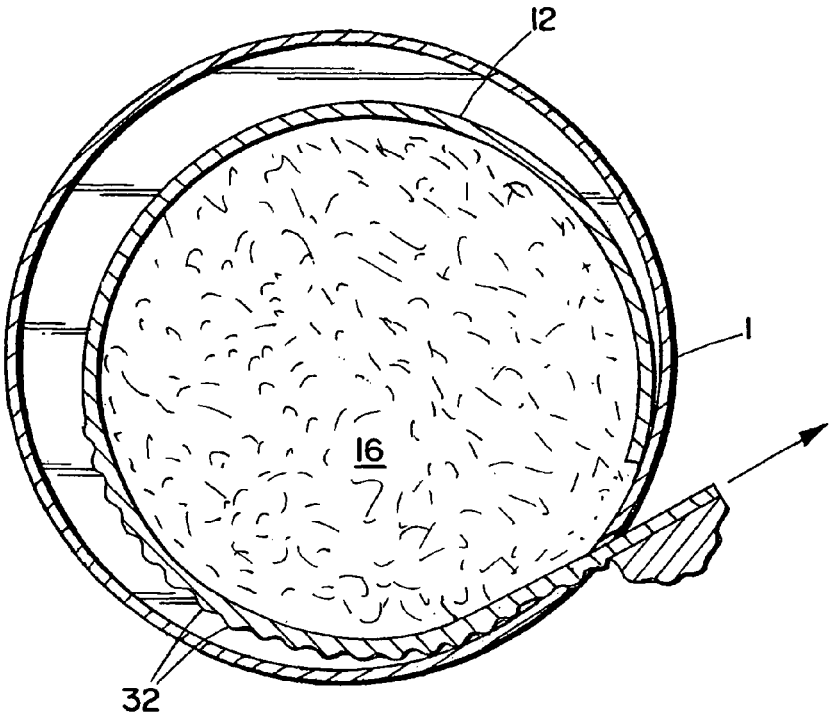
FIG. 13 is a sectional view taken along line 13-13 of FIG. 12 showing the inner wall in a non-compacting position.
Figure 14:
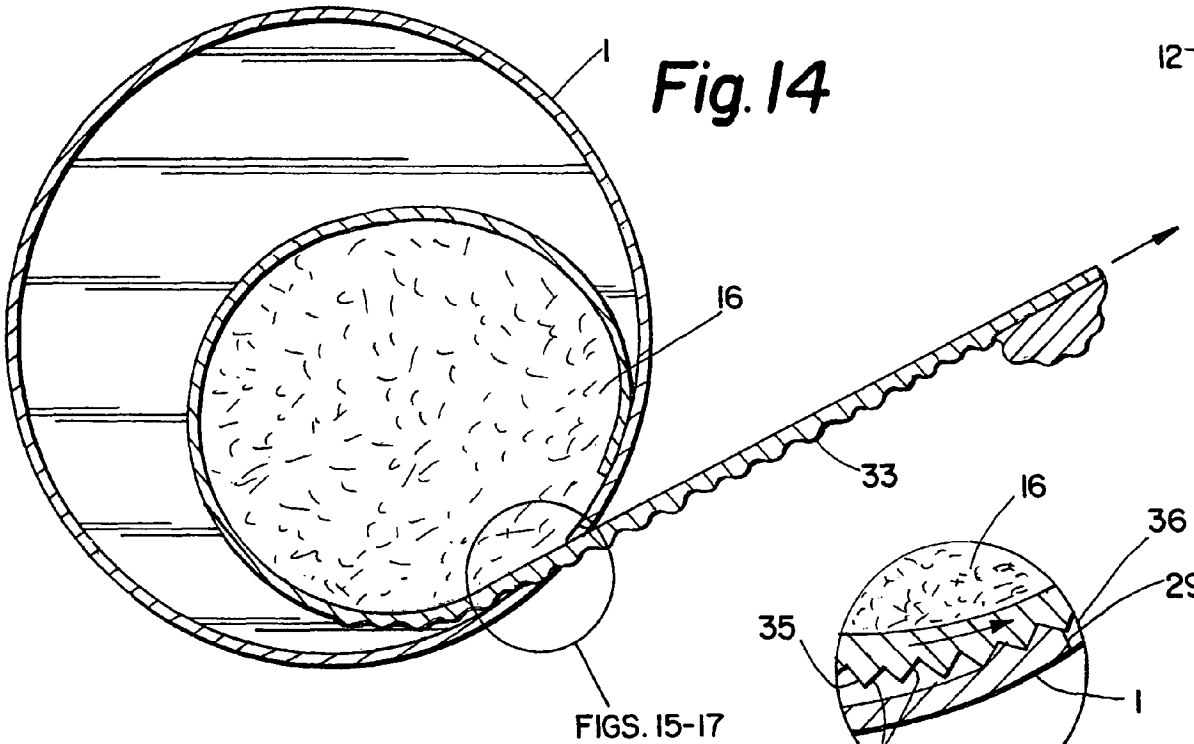
FIG. 14 is a sectional view taken along line 13-13 of FIG. 12 showing the inner wall in a compacting position.

As shown in FIGS. 7 and 9-11, a third embodiment of the present invention includes a substantially cylindrical body 28 which defines a substantially cylindrical outer wall 1 have an interior surface 14. A base 28 is defined by and forms a portion of the body 28. A lid 5 is detachably connected to the body 28. A flexible inner wall 12 is connected at a fixed end 13 to the interior surface 14 of the body 28 and extends along the interior surface 14 and through a port 37 defined by the body 28. A guide pocket 38 formed by the body 28 receives the flexible inner wall 12 as it extends through the port 37. The flexible inner wall 12 extends within the guide pocket 38 and generally around the circumference of the body 28. A slot 39 is defined by the guide pocket 38 for accessing the flexible inner wall 12 via a slider 41 connected to the distal end 15 of the flexible inner wall 12. The slider 41 extends through the slot 39 and is used to urge the flexible inner wall 12 along the length of the guide pocket 38. A plurality of pocket teeth 42 are defined by the guide pocket 38 for selective interlaced engagement with a plurality of opposing alternate wall teeth 43 defined by the flexible inner wall 12. The alternate wall teeth 43, when engaged with the pocket teeth 42, lock the flexible inner wall 12 in temporarily fixed relation to the guide pocket 38. However, the user may press the slider 41 toward the body 28 to disengage the alternate wall teeth 43 from the pocket teeth 42 to allow the user to urge the flexible inner wall 12 in either direction within the guide pocket 38. As is shown in FIG. 10, urging the flexible inner wall 12 in a first direction (counter-clockwise in FIG. 10) will urge more of the flexible inner wall 12 within the guide pocket 38 thus collapsing the cylindrical volume 16 and compacting any tobacco stored therein. (As shown in FIG. 11, urging the flexible inner wall 12 in an opposite second direction (clockwise in FIG. 11) will urge the flexible inner wall 12 within the body 28 thus expanding the cylindrical volume 16 and thus releasing the compaction of the tobacco product contained therein. The purpose of this embodiment is to provide the advantage of containing the flexible inner wall 12 within the body 28 while eliminating the use of the slidably connected bottom 9 referenced in the preferred embodiment. The distinction is a manufacturing or method of operation choice. All embodiments of the present invention apply the concept of urging the flexible inner wall 12 to compact tobacco within a cylindrical container.

Figure 8:
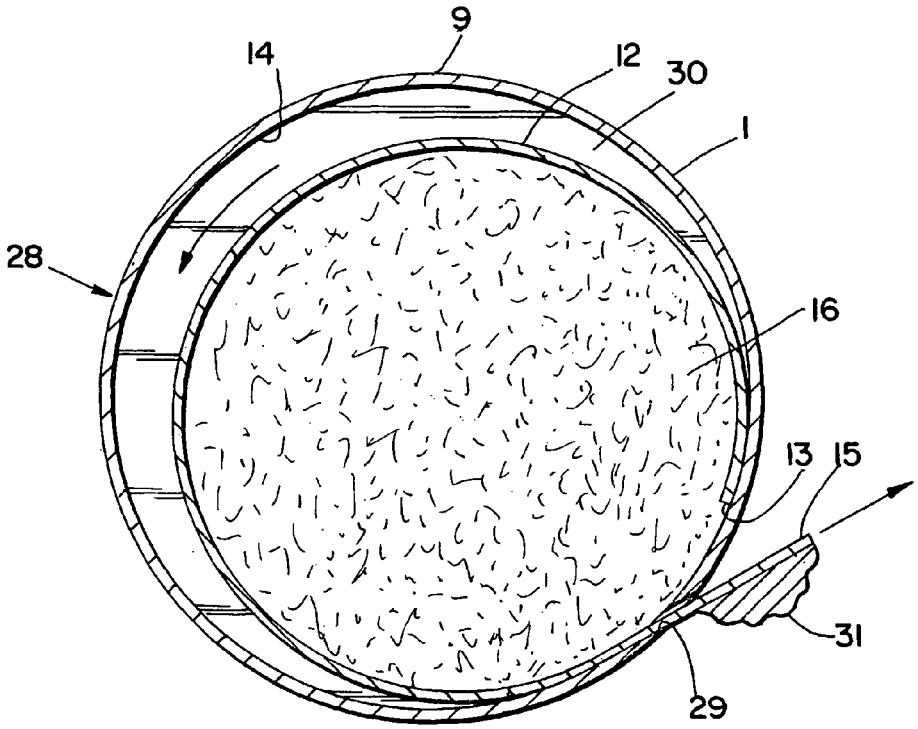
FIG. 8 is a cross-sectional plan view of a fourth embodiment of the present invention.
Figure 9:
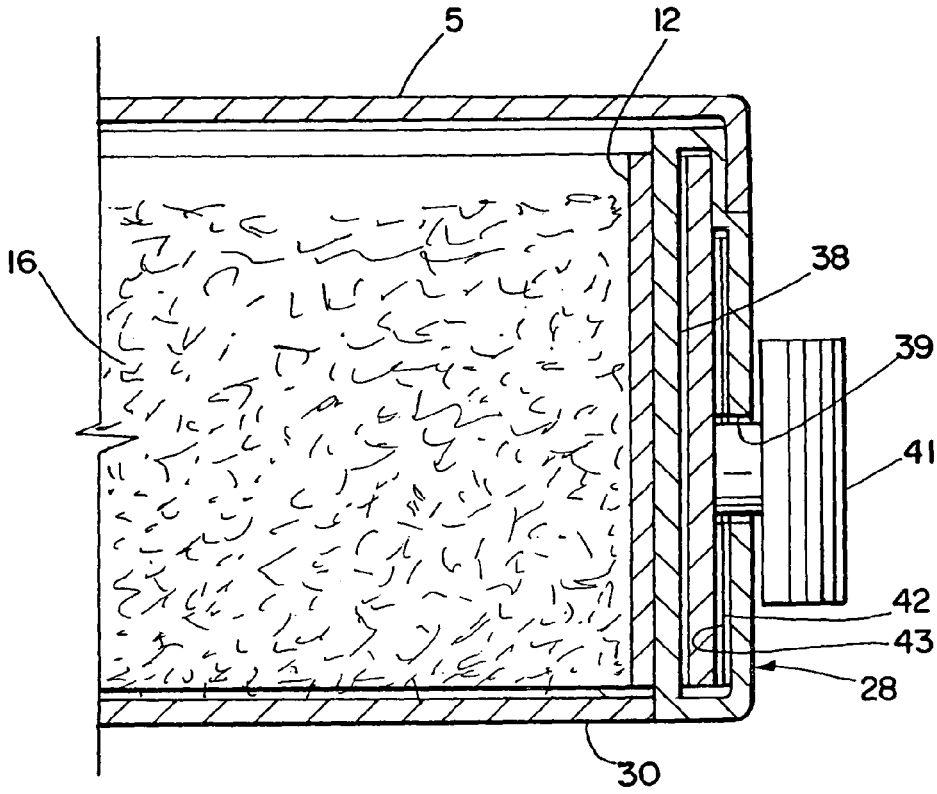
FIG. 9 is a partial sectional view taken along line 9-9 of FIG. 7.

As shown in FIG. 8 a fourth embodiment of the present invention includes a substantially cylindrical body 28 wherein the cross-sectionally circular outer wall 1 is intricately connected to a base 30. The flexible inner wall 12 is connected at its fixed end 13 to the interior surface 14 of the outer wall 9 and extends generally along the interior surface 14 of the outer wall 1 and through an aperture 29 defined by the outer wall 1. A grip 31 is connected to the distal end 15 of the flexible inner wall 12. The user may pull the grip 31 and thus urge the flexible inner wall 12 from within the body 28, thus causing the cylindrical volume 16 to collapse. Again, any tobacco contained within this cylindrical volume 16 will be compacted.

Figure 15:
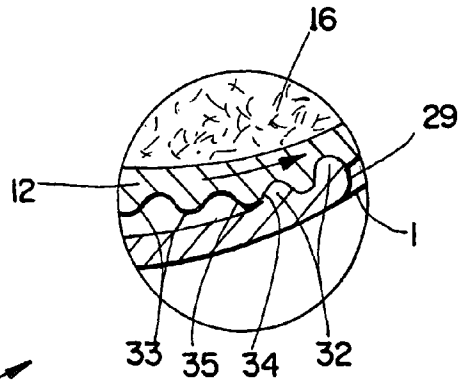
FIG. 15 is a detailed view of the fifth embodiment of the present invention taken from FIG. 14 showing the aperture teeth and inner wall teeth.
Figure 17:
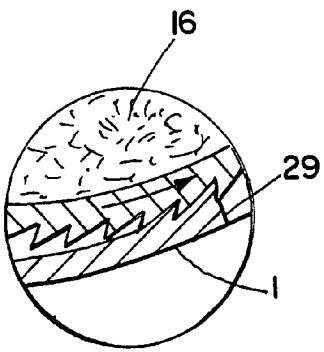
FIG. 17 is a similar detailed view as shown in FIG. 15 with yet other alternate aperture teeth and inner wall teeth.
Figure 16:
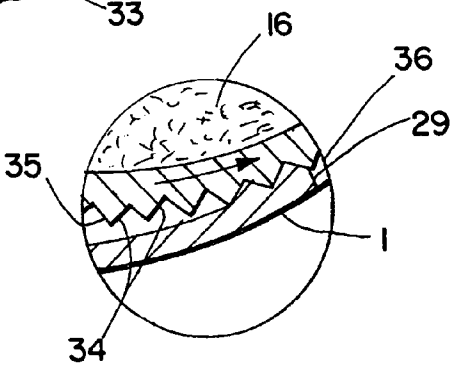
FIG. 16 is a similar detailed view as shown in FIG. 15 with alternate aperture teeth and inner wall teeth.

As shown in FIGS. 12-17, a fifth embodiment of the present invention includes the flexible inner wall 12 which may be locked in temporarily fixed relation to the outer wall 1 by a plurality of aperture teeth 32 defined by the outer wall 1 and partially defining the aperture 29 and a corresponding plurality of inner wall teeth 33 defined by the flexible inner wall 12 opposite and in interlaced relation to the plurality of aperture teeth 32. A primary embodiment of the aperture teeth 32 and inner wall teeth 33 are shown in FIG. 16. The teeth 32 and 33 are held in engagement by the elastic nature of the material preferably used to manufacture the flexible inner wall 12 and the expansive nature of the tobacco product compacted thereby. This embodiment also includes a lid 5 as described in the preferred embodiment. Alternate embodiments of the teeth 32 and 33 are shown in FIGS. 15 and 17.

While we have shown our invention in numerous forms, it will be obvious to those skilled in the art that it is not so limited but is susceptible of various changes and modifications without departing from the spirit thereof.

What we claim is:

1. A container, used primarily to store chopped tobacco, comprising:

a. A substantially cylindrical outer wall defining a circular top edge and a circular bottom edge, each circumscribing a common axis;

b. A lid detachably connected to said outer wall for covering an upper opening defined by said upper edge;

c. A bottom slidably connected to said outer wall for rotation about said common axis and covering a lower opening defined by said lower edge; and d. A flexible inner wall having a fixed end attached to said outer wall and extending along said outer wall to a distal end connected to said bottom, said inner wall thus defining a substantially cylindrical volume, such that rotation of said bottom in a predetermined direction relative to said outer wall rotates said distal end along said inner wall and reduces said cylindrical volume.

2. A container as defined in claim 1 further comprising means, formed by said bottom and said outer wall, for locking said flexible inner wall in temporarily fixed relation to said outer wall.

3. A container as defined in claim 2 wherein said locking means comprises a plurality of bottom teeth defined by said bottom around the circumference thereof and engaging a plurality of outer wall teeth defined by said outer wall opposite to and engaging said bottom teeth, wherein said bottom teeth and outer teeth are shaped to accommodate forced rotation of said bottom relative to said outer wall while simultaneously resisting inadvertent rotation of said bottom relative to said outer wall.

4. A container used primarily to store chopped tobacco, comprising:

a. A substantially cylindrical body forming a cross-sectionally circular outer wall;
b. A lid covering an upper opening defined by an upper edge of said outer wall;
c. A flexible inner wall connected at a fixed end to said outer wall and coextending along said outer wall, thus defining a substantially cylindrical volume; and
d. means connected to said inner wall for urging said flexible inner wall in sliding movement relative to said fixed end to reduce said cylindrical volume defined by said inner wall.

5. A container as defined in claim 4 wherein said body comprises a base fixed to said lower edge of said outer wall.

6. A container as defined in claim 4 wherein said outer wall defines an aperture through which said inner wall extends.

7. A container as defined in claim 6 wherein said urging means comprises a grip connected to a distal end of said inner wall and outside said body such that a user may hold said grip and pull said inner wall through said aperture thus reducing said cylindrical volume defined by said inner wall.

8. A container as defined in claim 6 further comprising means for selectively locking said flexible inner wall relative to said outer wall.

9. A container as defined in claim 8 wherein said locking means comprises a plurality of aperture teeth defined by said outer wall and partially defining said aperture and engaging a plurality of inner wall teeth defined by said inner wall opposite said aperture teeth, wherein said aperture teeth and said inner wall teeth are shaped to facilitate sliding movement of said inner wall outwardly through said aperture and to resist the movement of said inner wall inwardly through said aperture.

10. A container as defined in claim 4 wherein said urging means further comprises a bottom slidably attached to a circular bottom edge of said outer wall and over a bottom opening defined by said circular bottom edge for rotational movement about an axis common to said outer wall and said bottom, wherein a distal end of said inner wall is connected to said bottom such that rotational movement of said movement about said common axis will urge said distal end about said common axis thus collapsing or expanding said cylindrical volume responsive to the direction the bottom is rotated.

11. A container as defined in claim 10 further comprising means for locking said bottom in fixed relation to said outer wall.

12. A container as defined in claim 11 wherein said locking means comprises a plurality of bottom teeth defined by said bottom around the circumference thereof and engaging a plurality of outer wall teeth defined by said outer wall opposite to and engaging said bottom teeth, wherein said bottom teeth and outer teeth are shaped to accommodate selective rotation of said bottom relative to said outer wall while resisting inadvertent rotation of said bottom relative to said outer wall.

13. A container as defined in claim 4 wherein said urging means comprises a bottom slidably connected to said outer wall and obstructing a lower opening defined by said outer wall, wherein said bottom defines a plurality of sloped bottom teeth positioned in opposite interlocking engagement with a plurality of sloped outer wall teeth, defined by said outer wall such that the rotation of said bottom in a first direction is permitted by said bottom teeth and said outer wall teeth but rotation of said bottom in an opposite, second direction is obstructed by the engagement of said bottom teeth and said outer wall teeth.

14. A container, used primarily to store chopped tobacco, comprising:

a. A body defining a substantially cylindrical interior surface and a base;
b. A flexible inner wall connected at a first end to said interior surface of said body and extending along said interior surface and through a port defined by said body;
c. A guide pocket formed on said body for receiving the flexible inner wall as it extends through said port; and
d. Means connected to said inner wall for urging said inner wall in sliding movement within said guide pocket.

15. A container as defined in claim 14 wherein said guide pocket defines a slot through which said flexible inner wall may be accessed.

16. A container as described in claim 14 further comprising means connected to said body for locking said flexible inner wall in fixed relation to said guide pocket.

17. A container as described in claim 15 further comprising means connected to said body for locking said flexible inner wall in fixed relation to said guide pocket.

18. A container as defined in claim 17 wherein said locking means comprises a plurality of sloped pocket teeth defined by said guide pocket and a plurality of sloped inner wall teeth defined by said inner wall in opposing engagement with said pocket teeth.

19. A container as defined in claim 18 wherein said urging means comprises a slider connected to said flexible wall and extending through said slot, wherein said slider may be pushed towards said body to disengage said inner wall teeth from said pocket teeth and to urge said flexible wall along the length of said pocket guide.

20. A container as defined in claim 16 wherein said urging means comprises a slider connected to said flexible wall for urging said flexible wall along the length of said guide pocket.

* * * * *